US007637057B2

(12) United States Patent
Matsui et al.

(10) Patent No.: US 7,637,057 B2
(45) Date of Patent: Dec. 29, 2009

(54) OPERATING MECHANISM FOR AN OPEN/CLOSE OBJECT

(75) Inventors: Seika Matsui, Chiryu (JP); Hideharu Kato, Toyota (JP); Tsutomu Tanoi, Aichi (JP); Tomonori Suzuki, Seto (JP); Mizuho Morimitsu, Toyota (JP)

(73) Assignees: Aisin Seiki Kabushiki Kaisha, Kariya-Shi, Aichi (JP); Toyota Jidosha Kabushiki Kaisha, Toyota-Shi, Aichi (JP); Toyota Shatai Kabushiki Kaisha, Kariya-Shi, Aichi (JP)

( * ) Notice: Subject to any disclaimer, the term of this patent is extended or adjusted under 35 U.S.C. 154(b) by 634 days.

(21) Appl. No.: 10/512,559

(22) PCT Filed: Apr. 25, 2003

(86) PCT No.: PCT/JP03/05326

§ 371 (c)(1),
(2), (4) Date: May 27, 2005

(87) PCT Pub. No.: WO03/091524

PCT Pub. Date: Nov. 6, 2003

(65) Prior Publication Data

US 2005/0237018 A1 Oct. 27, 2005

(30) Foreign Application Priority Data

Apr. 25, 2002 (JP) ..... 2002-124227

(51) Int. Cl.
*E05F 11/28* (2006.01)

(52) U.S. Cl. ..... 49/345; 296/56; 49/341

(58) Field of Classification Search ..... 49/340, 49/341, 345; 296/56; 318/282, 286, 466, 318/468, 471, 432, 433
See application file for complete search history.

(56) References Cited

U.S. PATENT DOCUMENTS 4,959,598 A * 9/1990 Yoshida et al. ..... 318/599

(Continued)

FOREIGN PATENT DOCUMENTS

JP 3-35184 4/1991

(Continued)

OTHER PUBLICATIONS

International Search Report PCT/ISA/210.
Chinese Office Action dated Nov. 4, 2005.

*Primary Examiner*—Jerry Redman
(74) *Attorney, Agent, or Firm*—Buchanan Ingersoll & Rooney PC

(57) ABSTRACT

An operating mechanism for an open/close object comprising a driving device for driving and opening the open/close object, a position detecting device for detecting an open position of the open/close object (1), and a fully open position storage device for storing a fully open position of the open/close object, wherein, when the driving device drives and opens the open/close object, the driving device is stopped in a fully open recognition position stored in the fully open position storage device or a position a fixed amount short of the fully open recognition position. When a current position of the open/close object after completion of the opening drive by the driving device is different from the fully open recognition position (#1), the fully open position storage device sets a new fully open recognition position (#2).

20 Claims, 11 Drawing Sheets

U.S. PATENT DOCUMENTS

| | | | | |
|---|---|---|---|---|
| 5,770,934 | A * | 6/1998 | Theile | 318/469 |
| 5,982,126 | A * | 11/1999 | Hellinga et al. | 318/468 |
| 6,100,657 | A * | 8/2000 | Lamm et al. | 318/280 |
| 6,566,828 | B2 * | 5/2003 | Fitzgibbon et al. | 318/283 |
| 6,597,139 | B1 * | 7/2003 | Klesing | 318/445 |
| 6,600,285 | B2 * | 7/2003 | Mintgen et al. | 318/468 |
| 6,719,356 | B2 * | 4/2004 | Cleland et al. | 296/146.8 |
| 6,756,757 | B2 * | 6/2004 | Marcinkiewicz et al. | 318/432 |
| 6,870,334 | B2 * | 3/2005 | Jurado et al. | 318/282 |
| 6,940,240 | B2 * | 9/2005 | Kelkhoff et al. | 318/282 |
| 7,015,669 | B2 * | 3/2006 | Nagashima et al. | 318/443 |
| 7,019,478 | B2 * | 3/2006 | Gregori et al. | 318/282 |
| 7,049,785 | B2 * | 5/2006 | Han | 318/696 |
| 7,057,519 | B2 * | 6/2006 | Study et al. | 340/686.6 |
| 7,339,336 | B2 * | 3/2008 | Gregori | 318/282 |
| 7,405,530 | B2 * | 7/2008 | Keller, Jr. | 318/466 |
| 2002/0008400 | A1 | 1/2002 | Hess et al. | |
| 2003/0193304 | A1 * | 10/2003 | Fitzgibbon | 318/282 |
| 2004/0006918 | A1 * | 1/2004 | Fitzgibbon | 49/28 |
| 2004/0032232 | A1 * | 2/2004 | Murray et al. | 318/434 |
| 2004/0216379 | A1 * | 11/2004 | Gioia et al. | 49/29 |
| 2006/0255757 | A1 * | 11/2006 | Sommer | 318/468 |

FOREIGN PATENT DOCUMENTS

| | | |
|---|---|---|
| JP | 3-41088 | 4/1991 |
| JP | 3-41089 | 4/1991 |
| JP | 5-202671 | 8/1993 |
| JP | 7-62947 | 3/1995 |
| JP | 7-166761 | 6/1995 |
| JP | 7-180430 | 7/1995 |
| JP | 2001-180283 | 7/2001 |
| JP | 2002-13347 | 1/2002 |
| JP | 2004-150125 | 5/2004 |
| JP | 2004-162437 | 6/2004 |

* cited by examiner

OPERATING MECHANISM FOR AN OPEN/CLOSE OBJECT

TECHNICAL FIELD

The present invention relates to an operating mechanism for an open/close object comprising a driving device for driving open the open/close object, a position detecting device for detecting an open position of the open/close object, and a fully open position storage device for storing a fully open position of the open/close object, wherein, when said driving device drives open said open/close object, said driving device is stopped in the fully open recognition position stored in said fully open position storage device or in a position a fixed amount short of the fully open recognition position.

BACKGROUND ART

Conventionally, among back doors of minivans or the like, some back doors are automatically openable by a driving device. An automatic opening and closing apparatus of such a door is shown in Japanese Utility Model Application "Kokai" No. Hei 3-41088, for example.

That is, the above apparatus has an opening and closing mechanism for automatically opening and closing a door with an actuator. The opening and closing mechanism has a door opening detector in the form of a hole sensor for outputting a signal corresponding to an opening degree of the door.

This apparatus aims at detecting accurately, with this hole sensor, not only a full opening and a full closing of the door but opening degrees of the door in the course of its opening and closing.

However, the above conventional automatic opening and closing apparatus has the following problems.

For example, different vehicles have different door attaching states, and the fully open position is not necessarily uniform. Therefore, while the above actuator accurately controls an amount of opening of the door, if a stop position of the door is set larger than a structural fully open position, an excessive force will be applied to door hinges and the like, resulting in an inconvenience such as damage to the door hinges or defective fitting of the door.

Where a stop position is in the opening side of the structural fully open position of the door, the door will reach the structural fully open position without a stop control of the automatic opening operation of the door. The opening operation will become unpleasant to the sight.

On the other hand, where a stop position of the door by the actuator is set smaller than the structural fully open position, the door opening itself becomes small which encumbers loading and unloading of baggage.

Where dampers or the like are used in combination, after driving by the actuator, a further opening operation is performed by the dampers, so that the opening operation becomes a two-stage operation which is unsightly also.

The object of this invention is to solve the above conventional problems, and provide an operating mechanism for an open/close object which performs a sightly opening operation without damaging a mounting structure of the open/close object.

DISCLOSURE OF THE INVENTION

An operating mechanism for an open/close object according to the present invention has the following characterizing features:

A first characterizing feature according to the present invention lies in that, as shown in FIGS. 1 through 4, an operating mechanism for the open/close object 1 comprises a driving device 3 for driving open the open/close object 1, a position detecting device for detecting an open position of the open/close object 1, and a fully open position storage device 5*a* for storing a fully open position of the open/close object 1, wherein, when said driving device 3 drives open said open/close object 1, said driving device 3 is stopped in a fully open recognition position stored in said fully open position storage device 5*a* or a position a fixed amount short of the fully open recognition position, and when a current position of the open/close object 1 after completion of the opening drive by said driving device 3 is different from said fully open recognition position, said fully open position storage device 5*a* sets a new fully open recognition position.

The current position of the open/close object after completion of the opening drive by said driving device, in many cases, means the structural fully open position of the open/close object. That is, the operating mechanism having this construction is given a position learning function for gradually bringing the currently recognized fully open recognition position close to the structural fully open position of the open/close object. With such a learning function, even when an initial fully open position of the open/close object is set provisionally, the open/close object can be driven to open to the vicinity of the structural fully open position by the learning function. This renders an automatic opening operation of the open/close object pleasing to the sight.

And the open/close object may be opened without applying an excessive force to the mounting mechanism and the like of the open/close object.

A second characterizing feature according to the present invention lies in that, as shown in FIGS. 1 and 4, in the first characterizing feature, when said current position is a position open to a larger extent than said fully open recognition position (#1), said fully open position storage device 5*a* recognizes said current position to be said new fully open recognition position (#2).

Generally, said current position often is the structural fully open position of the open/close object. Therefore, when, as in this construction, the current position after completion of an opening operation is recognized to be a new fully open recognition position, a next opening operation will be aimed at the structural fully open position. In this way, a stopping position of the open/close object may be brought close to said structural fully open position promptly.

A third characterizing feature according to the present invention lies in that, as shown in FIGS. 1 and 5, in the first characterizing feature, when said current position is a position open to a larger extent than said fully open recognition position (#1), said fully open position storage device 5*a* recognizes a position between said current position and said fully open recognition position to be said new fully open recognition position (#2).

This arrangement can check an abrupt correction of the fully open recognition position of the open/close object, and thus is free from a situation where a position for ending the opening operation overshoots the structural fully open position. Therefore, while preventing an inconvenience such as damage to the mounting part of the open/close object, the fully open recognition position of the open/close object may gradually be brought close to the structural fully open position.

A fourth characterizing feature according to the present invention lies in that, as shown in FIGS. 1 and 6, in the first characterizing feature, said fully open position storage device 5*a* recognizes a current position of said open/close object 1 upon lapse of a fixed time (#3) after completion of the opening drive by said driving device 3 (#1, 2), to be said new fully open recognition position (#4).

Where, as in this arrangement, the current position of the open/close object upon lapse of a fixed time is recognized, even when the open/close object temporarily operates to a position different from the fully open position owing to an unexpected factor, e.g. a manual force or wind pressure, the fully open position may be detected after lapse of a time at which the open/close object is thought to have stopped still in the structural fully open position. Therefore, it is possible to avoid a situation effectively in which an excessive or insufficient position is regarded as a fully open recognition position by mistake.

A fifth characterizing feature according to the present invention lies in that, as shown in FIGS. 1 and 7, in the first characterizing feature, said fully open position storage device 5*a* recognizes a position between a position of said open/close object 1 and said fully open recognition position upon lapse of a fixed time (#3) after completion of the opening drive by said driving device 3 (#1, 2), to be said new fully open recognition position (#4).

Where, as in this arrangement, a new fully open recognition position is set between the current position after lapse of said fixed time and the currently recognized fully open recognition position, an abrupt correction of the fully open recognition position of the open/close object may be checked. Thus, while preventing an inconvenience such as damage to the mounting part of the open/close object, for example, the fully open recognition position of the open/close object may gradually be brought close to the structural fully open position.

A sixth characterizing feature according to the present invention lies in that, as shown in FIGS. 1 and 8, in the first characterizing feature, said open/close object 1 includes an overload checking device, and when the overload checking device detects an overload (#2) in a predetermined region which is a region adjacent said fully open recognition position (#1), said fully open position storage device 5*a* recognizes a position open to a smaller extent than said fully open recognition position to be said new fully open recognition position (#3).

If the fully open recognition position is open to a larger extent than the structural fully open position of the open/close object, an overload will act on the mounting part or the like of the open/close object. Where, as in this arrangement, a position open to a smaller extent than the current fully open recognition position to be a new fully open recognition position when an overload is detected, the above overload may be prevented, thereby effectively preventing damage to the open/close object or the driving device.

A seventh characterizing feature according to the present invention lies in that, as shown in FIG. 1, in the first characterizing feature, said open/close object 1 includes an open/close object raising mechanism 30 for biasing said open/close object 1 in an opening direction, which causes an opening operation from a position where said drive device 3 is stopped to a structural fully open position of said open/close object 1.

As in this construction, an open/close object raising mechanism such as air dampers may be provided to stop the drive by the driving device short of the current fully open recognition position, and to open the open/close object reliably to the structural fully open position, while avoiding damage to the open/close object.

An eighth characterizing feature according to the present invention lies in that, as shown in FIGS. 1 and 9, in the seventh characterizing feature, when said open/close object 1 operates at least a fixed amount to an opening side (#4) within a fixed time (#3) after completion of the opening drive by said driving device 3 (#1, 2), and a current position of said open/close object 1 is a position open to a larger extent than said fully open recognition position (#5), said current position is recognized to be said new fully open recognition position (#6).

In this construction, the open/close object has a mixture of the opening operation by the driving device and the opening operation by the open/close object raising mechanism. Based on a fixed time at which the opening operation by the open/close object raising mechanism is expected to have settled, when the open/close object stays still in a position open to a larger extent by a fixed amount than the current fully open recognition position, a new full open recognition position is established.

Therefore, since the opening operation by the open/close object raising mechanism may be set to a minimal stroke, the opening operation of the open/close object is smooth and pleasing to the sight.

A ninth characterizing feature according to the present invention lies in that, as shown in FIGS. 1 and 10, in the seventh characterizing feature, when said open/close object 1 operates at least a fixed amount to an opening side (#4) within a fixed time (#3) after completion of the opening drive by said driving device 3 (#1, 2), and a current position of said open/close object 1 is a position open to a larger extent than said fully open recognition position (#5), a position between said current position and said fully open recognition position is recognized to be said new fully open recognition position (#6).

With this arrangement, in the open/close object using the opening drive by the open/close object raising mechanism, its fully open recognition position is not brought close to the structural fully open position at once, but may be brought close to the structural fully open position gradually. Therefore, while preventing an inconvenient such as damage to the mounting part of the open/close object, for example, the fully open recognition position of the open/close object may be brought close to the structural fully open position gradually.

A tenth characterizing feature according to the present invention lies in that, as shown in FIGS. 1 and 11, in the seventh characterizing feature, when said open/close object 1 does not operate at least a fixed amount to an opening side (#4) within a fixed time (#3) after completion of the opening drive by said driving device 3 (#1, 2), a position open to a smaller extent than said fully open recognition position is recognized to be said new fully open recognition position (#5).

Where the open/close object raising mechanism is used in combination with the driving device, it is preferable that, after stopping the driving device in a position short of the fully open recognition position, the open/close object raising mechanism is caused to perform some opening operation and stop the open/close object in the structural fully open position.

However, when the current fully open recognition position is very close to the structural fully open position or beyond the structural fully open position, an amount of opening by the open/close object raising mechanism may not be obtained. If a malfunction occurs with the driving device, the open/close object will easily overshoot the structural fully open position, resulting in an inconvenience such as damage to the mounting part of the open/close object.

Thus, as in this arrangement, a new fully open recognition position is set to the closing side when the opening operation of the open/close object does not fulfill the predetermined conditions. This arrangement can effectively prevent an inconvenience such as the above damage.

BEST MODE FOR CARRYING OUT THE INVENTION

An embodiment of the present invention will be described hereinafter with reference to the drawings.

[Outline]

An operating mechanism for an open/close object according to the present invention will be described with reference to FIGS. 1 through 8.

Figure 1:
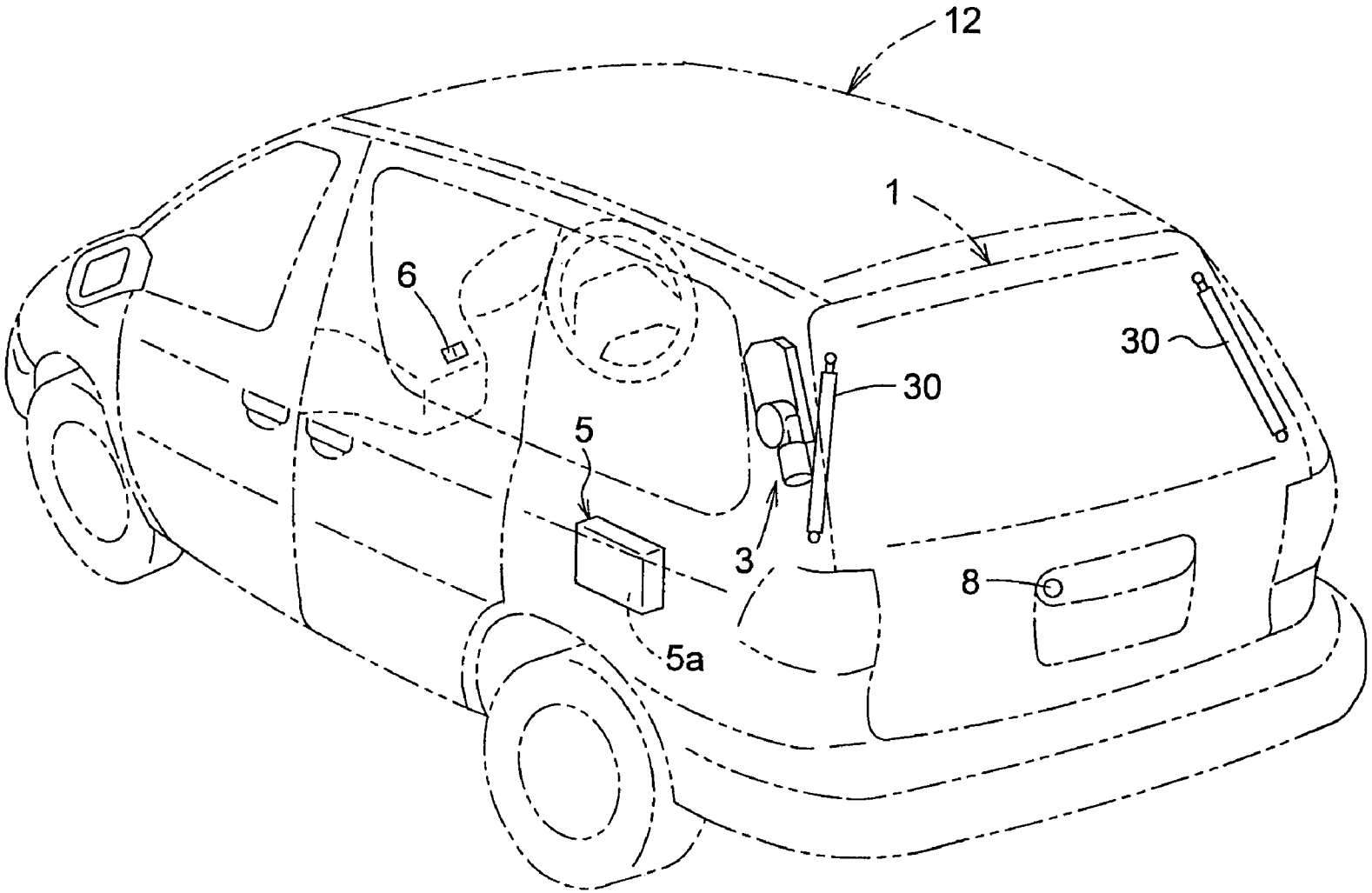
FIG. 1 is an explanatory view showing an outline of an operating mechanism for an open/close object according to the present invention.

The open/close object of the present invention is applied mainly to an open/close object automatically openable by a drive motor. It is applicable to a back door 1 of a minivan as shown in FIG. 1, for example, and also applicable to an ordinary vehicle door such as a trunk luggage door or slide door. Further, it is applicable to an ordinary garage door, which door is the type that opens upward.

Figure 2:
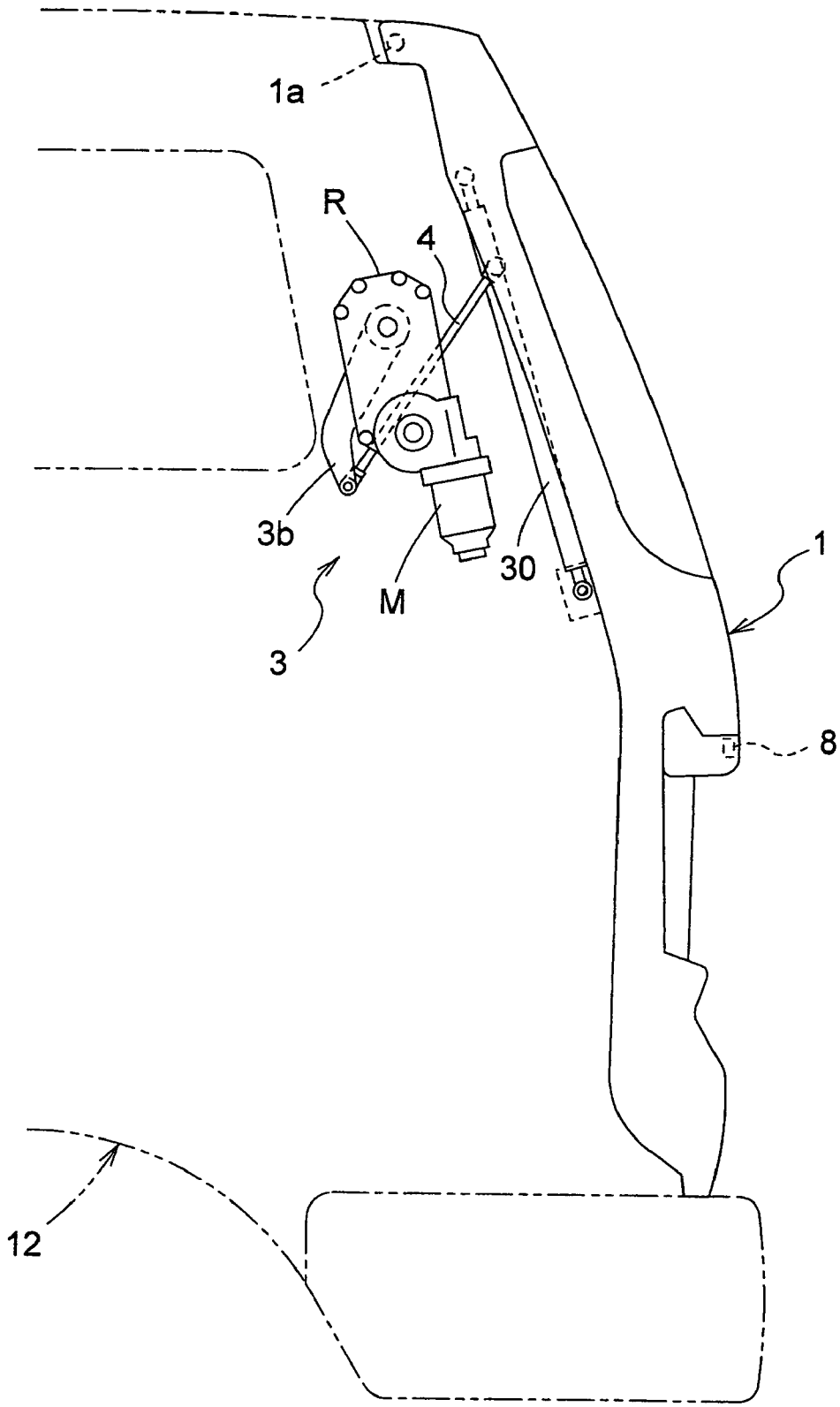
FIG. 2 is an explanatory view showing a fully closed state of the open/close object.

The example shown hereinafter is an application to the back door 1 of the minivan shown in FIG. 1. The back door 1, as shown in FIG. 2, is attached to an upper rear part of a vehicle body 12 through door hinges 1*a*. A driving device 3 is disposed on the vehicle body 12 for driving the back door 1 to an open position in response to operation of a main switch 6 disposed inside the vehicle or a handle switch 8 disposed on the back door 1, or a wireless remote control switch not shown.

Figure 3:
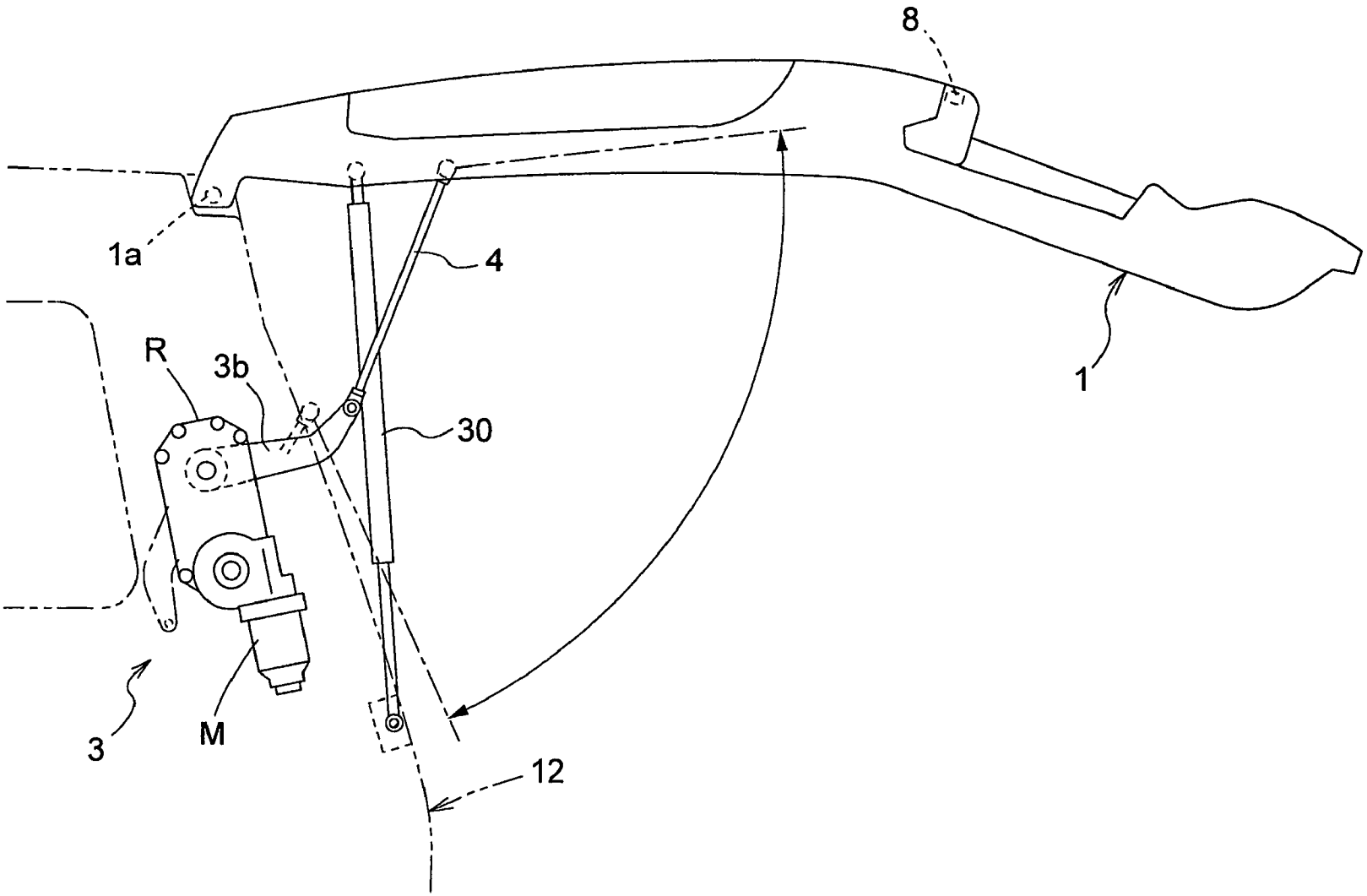
FIG. 3 is an explanatory view showing a fully open state of the open/close object.

FIG. 2 shows a fully closed state, while FIG. 3 shows a fully open state.

Said driving device 3 mainly includes a drive motor M, a reduction mechanism R for adjusting rotating speed of the drive motor M, an arm member 3b and rod 4 for connecting the reduction mechanism R and the back door 1, and further a controller 5 for controlling operation of said drive motor M. Air dampers 30 are disposed to extend between said vehicle body 12 and the back door 1 for supporting the back door 1 operated to a fully open position.

As said driving device 3, for example, a varied DC motor may be used along with a rotary encoder or the like, so that a turning angle and rotating speed of the drive motor M is controllable by said controller 5. This construction functions as a position detecting device for detecting a current position of the back door 1.

This position detecting device, based on an output from said rotary encoder or the like, outputs position data indicating a current position in an opening and closing direction of the back door 1 to the controller 5. The position data outputted from this position detecting device includes data obtained through a predetermined conversion performed based on the output from said rotary encoder or the like and directly indicating a current position of the back door 1, and the output itself from said rotary encoder or the like and indirectly indicating a current position of the back door 1. The data directly indicating a current position of the back door 1, for example, may be data expressed as an opening degree (angle from the fully closed position) of the back door 1 or as an operating angle of the arm member 3*b*.

The operating mechanism for the open/close object of this invention causes the fully open position of the back door 1 to be learned and recognized in order to drive the back door 1 to a proper position particularly when the back door 1 is opened by the driving device 3.

When the back door 1 is fully opened, it assumes a stationary posture in a structural fully open position. In principle, therefore, the proper position to which the back door 1 is driven is the structural fully open position. However, the structural fully open position of the back door 1 varies from vehicle to vehicle, and the position may also change with an increase in the number of opening and closing times.

Thus, in the operating mechanism for the open/close object of the present invention, an amount of automatic opening of the back door 1 is appropriately adjusted by the learning modes described hereinafter. In this embodiment, a fully open recognition position, current position and drive stop position are defined in the controller 5 as data corresponding to position data indicating positions in the opening and closing direction of the back door 1. These position data, with the larger values, represent the wider open positions of the back door 1.

(Learning Mode 1)

Figure 4:
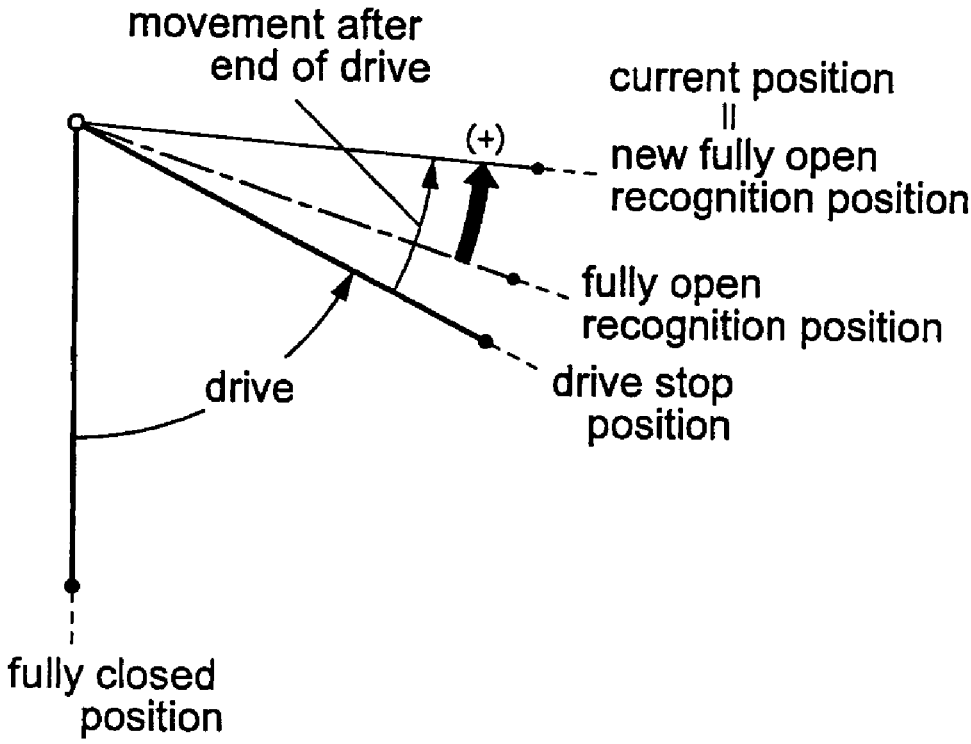
FIG. 4 is an explanatory view showing learning mode 1 of the operating mechanism according to the present invention.
Figure 4:
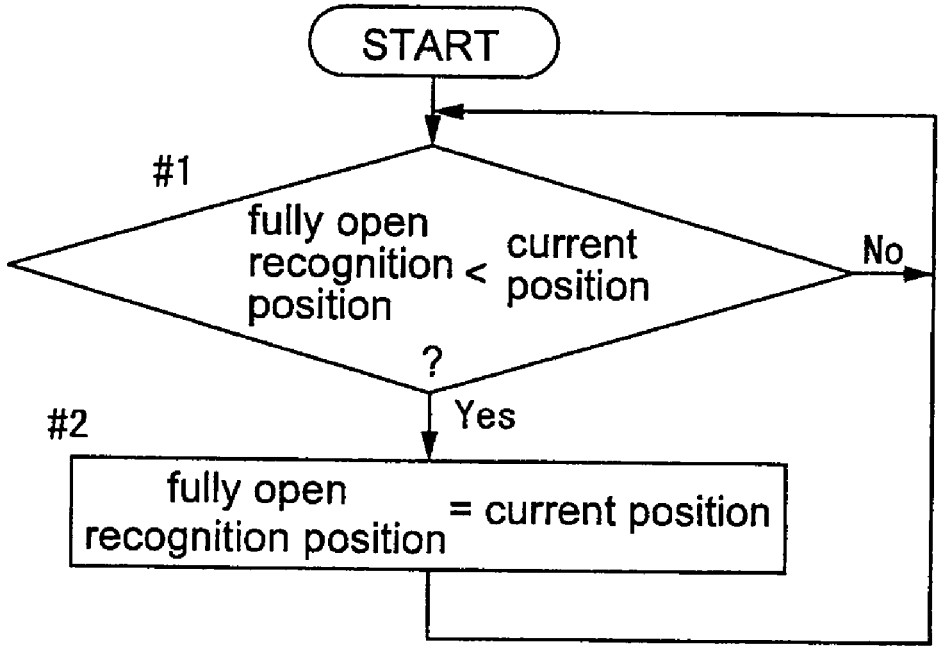

This mode will be described with reference to FIG. 4. FIG. 4 shows a schematic view showing operation of the back door 1, and a subroutine for causing said controller 5 to learn a fully open position.

In this learning mode, for example, when the drive motor M which is one example of driving device drives the back door 1, a current position after the opening operation of the back door 1 is completed is open to a larger extent than a fully open recognition position recognized by a fully open position storage device 5*a* of said controller 5, namely in time of "fully open recognition position<current position" (FIG. 4, #1), said fully open position storage device 5*a* is caused to adopt the current position as a new fully open recognition position (FIG. 4, #2).

Usually, the fully open recognition position of the back door 1 stored in the controller 5 is set open to a smaller extent than the structural fully open position of the back door 1 by taking an assembling dispersion of the back door 1 into account. The back door 1 is opened by the drive motor M to the fully open recognition position or to a position a fixed amount short of the fully open recognition position. This position is henceforth called the drive stop position.

Usually, an electromagnetic clutch of the drive motor M is operated in said drive stop position to disconnect the drive motor M. Generally, the back door 1 has air dampers 30 or the like which are one example of open/close object raising mechanism. Therefore, the back door 1 is further opened from said drive stop position by the air dampers 30, to be opened to and stay still in the structural fully open position.

According to this learning mode 1, when an opening operation ending position is open to a larger extent than the fully open recognition position currently recognized as noted above, the fully open recognition position is re-set to the opening side. Thus, even when an original fully open recognition position is set to a preliminary position in time of assembly of the open/close object, the fully open recognition position may be brought close to the structural fully open position promptly.

(Learning Mode 2)

Figure 5:
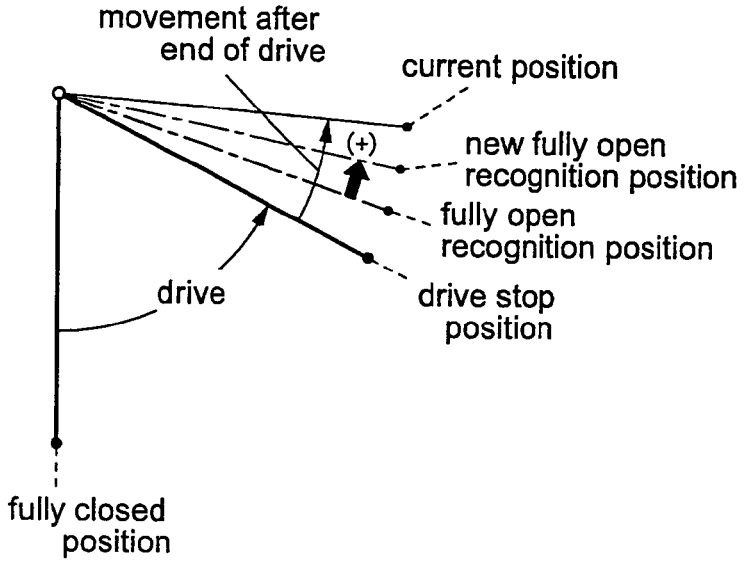
FIG. 5 is an explanatory view showing learning mode 2 of the operating mechanism according to the present invention.
Figure 5:
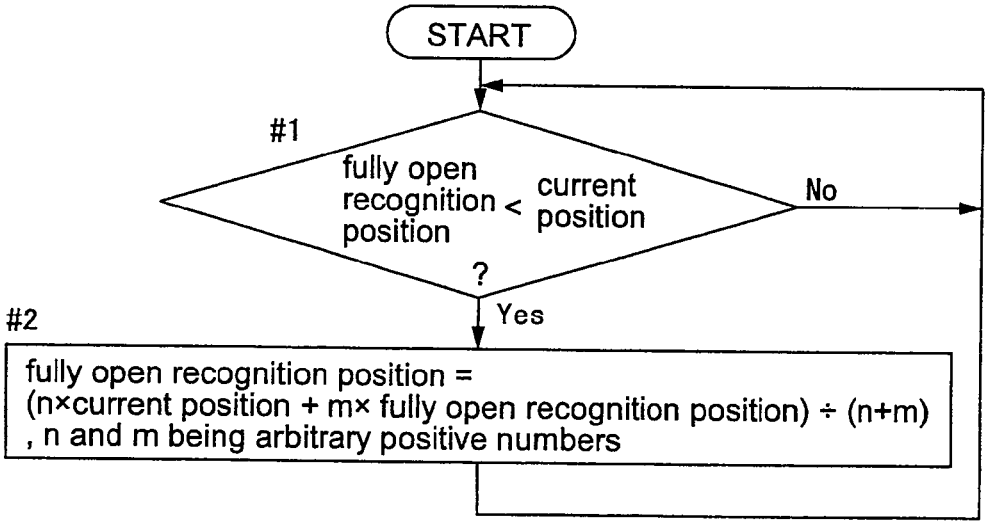

This learning mode will be described with reference to FIG. 5.

This learning mode sets a reduced amount to the correction of the fully open recognition position by the above learning mode 1. When the fully open recognition position by learning mode 1 is corrected, for example, the fully open position of the back door 1 next time should be the structural fully open position. However, a manual force or wind pressure could be added at a previous learning time. Such an unexpected factor could result in a fully open recognition position overshooting the structural fully open position. Even if the fully open recognition position is a correct position, it cannot be said that an error can never occur with the motor drive which would cause an overshoot beyond the structural fully open position, damaging the door hinges la and the like.

Thus, in this learning mode 2, when a current position of the back door 1 is open to a larger extent than the fully open recognition position, namely in time of "fully open recognition position <current position" (#1), said fully open position storage device 5*a* is caused to adopt a position between said current position and said fully open recognition position as a new fully open recognition position (#2). Specifically, in this embodiment, the controller 5 derives a new fully open recognition position by performing a calculation based on an equation "fully open recognition position=(n×current position+m×fully open recognition position)÷(n+m)", and stores it in the fully open position storage device 5*a*. Here, n and m are arbitrary positive numbers, and these values usually are set beforehand in time of delivery.

Specifically, for example, what is called filtering is applied, such as taking weighted averages, according to a current fully open position and a currently recognized fully open recognition position. With this arrangement, an abrupt correction of the fully open recognition position of the back door 1 may be checked to prevent an inconvenience such as damage to the mounting part of the back door 1. The fully open recognition position of the back door 1 may gradually be brought close to the structural fully open position.

(Learning Mode 3)

Figure 6:
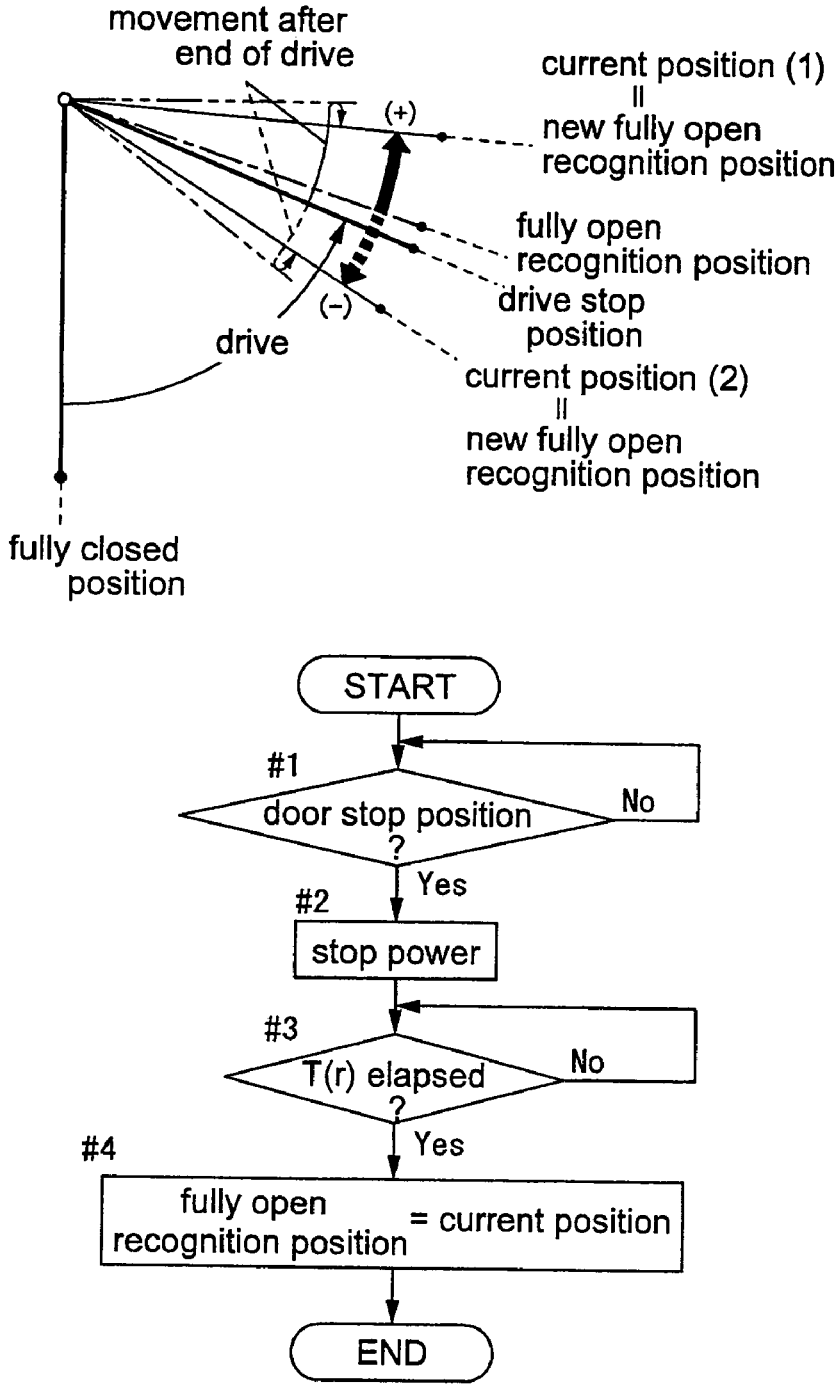
FIG. 6 is an explanatory view showing learning mode 3 of the operating mechanism according to the present invention.

This mode will be described with reference to FIG. 6. This learning mode takes a time component into consideration in determining a new fully open recognition position.

For example, an opened state of the back door 1 may temporarily become excessive or insufficient owing to a manual force or wind pressure applied to the back door 1 just before the back door 1 ends an opening operation by the drive. Where a method such as the above learning mode 1 is used in such a case, the new fully open recognition position will differ from the structural fully open position.

Thus, in this learning mode 3, after the opening drive by said driving device 3 is completed (#1, 2), upon lapse of a fixed time T(r) (#3), the fully open position storage device 5*a* recognizes a current position of the back door 1 to be a new fully open recognition position (#4). It is preferred here to set the fixed time T (r) longer than a time taken to operate the back door 1 to the structural fully open position after stopping in a position different from the fully open position owing to an unexpected factor. Such time is set by the rule of thumb, experiment or the like.

With this arrangement, even when the back door 1 temporarily operates to a position different from the fully open position owing to an unexpected factor, the fully open position may be detected after the back door 1 stops in the structural fully open position. Therefore, it is possible to avoid a situation effectively in which an excessive or insufficient position is regarded as a fully open recognition position by mistake.

(Learning Mode 4)

Figure 7:
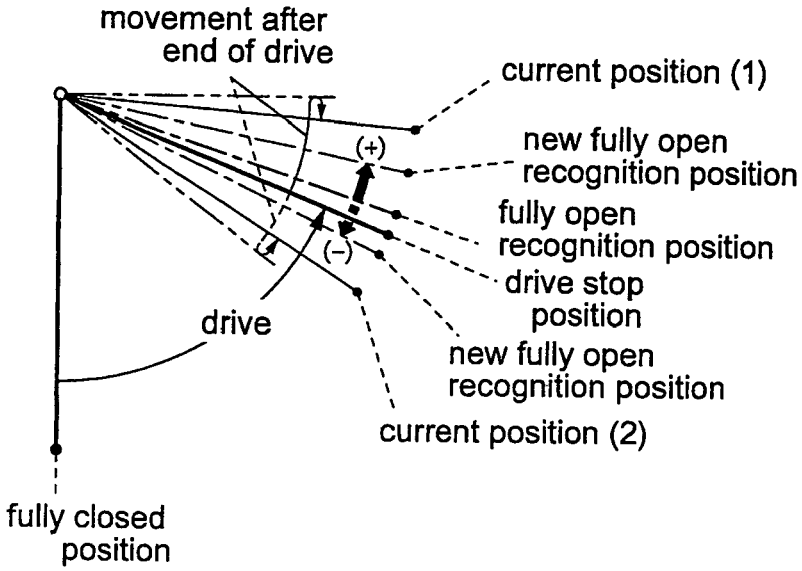
FIG. 7 is an explanatory view showing learning mode 4 of the operating mechanism according to the present invention.
Figure 7:
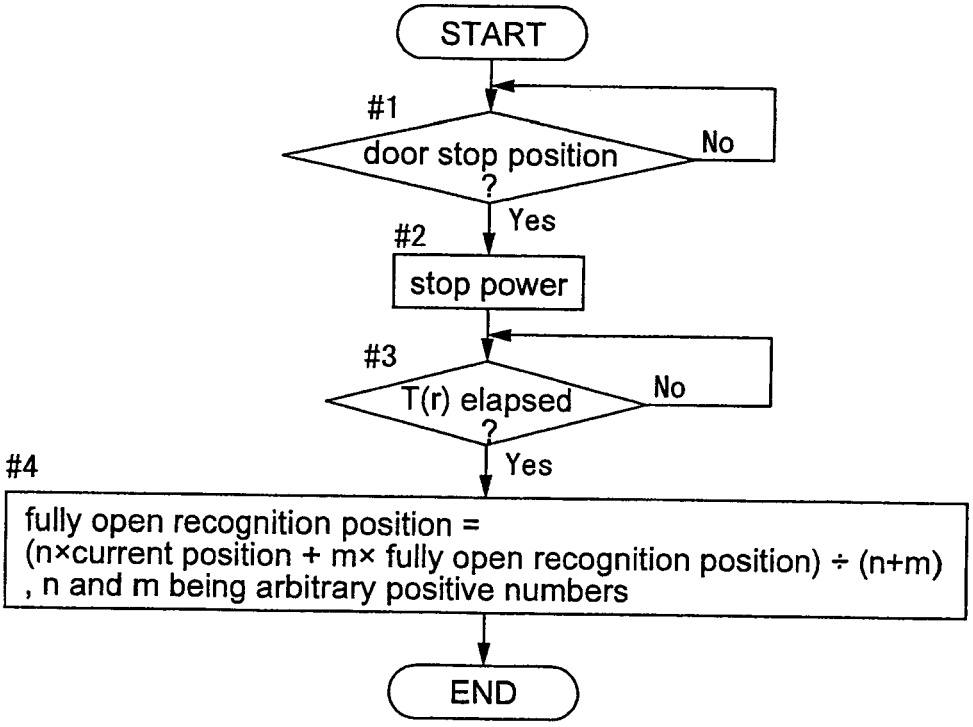

This learning mode will be described with reference to FIG. 7.

This learning mode sets a reduced amount to the correction of the fully open recognition position by the above learning mode 3. The purport of this learning mode is the same as the purport of learning mode 2 in relation to the foregoing learning mode 1.

Specifically, in this learning mode 4, after the opening drive by said driving device 3 is completed (#1, 2), upon lapse of the fixed time T(r) (#3), the fully open position storage device 5*a* recognizes a position between said position of the back door 1 and said fully open recognition position to be said new fully open recognition position (#4). Specific processes at #3 and #4 may be similar to the process at #2 in the above (Learning Mode 2).

According to this mode, an abrupt correction of the fully open recognition position of the back door 1 may be checked to prevent an inconvenience such as damage to the mounting part of the back door 1, for example. The fully open recognition position of the back door 1 may gradually be brought close to the structural fully open position.

(Learning Mode 5)

This learning mode will be described with reference to FIG. 8.

This learning mode corrects the fully open recognition position to the closing side particularly when the back door 1 is opened beyond the structural fully open position.

Figure 8:
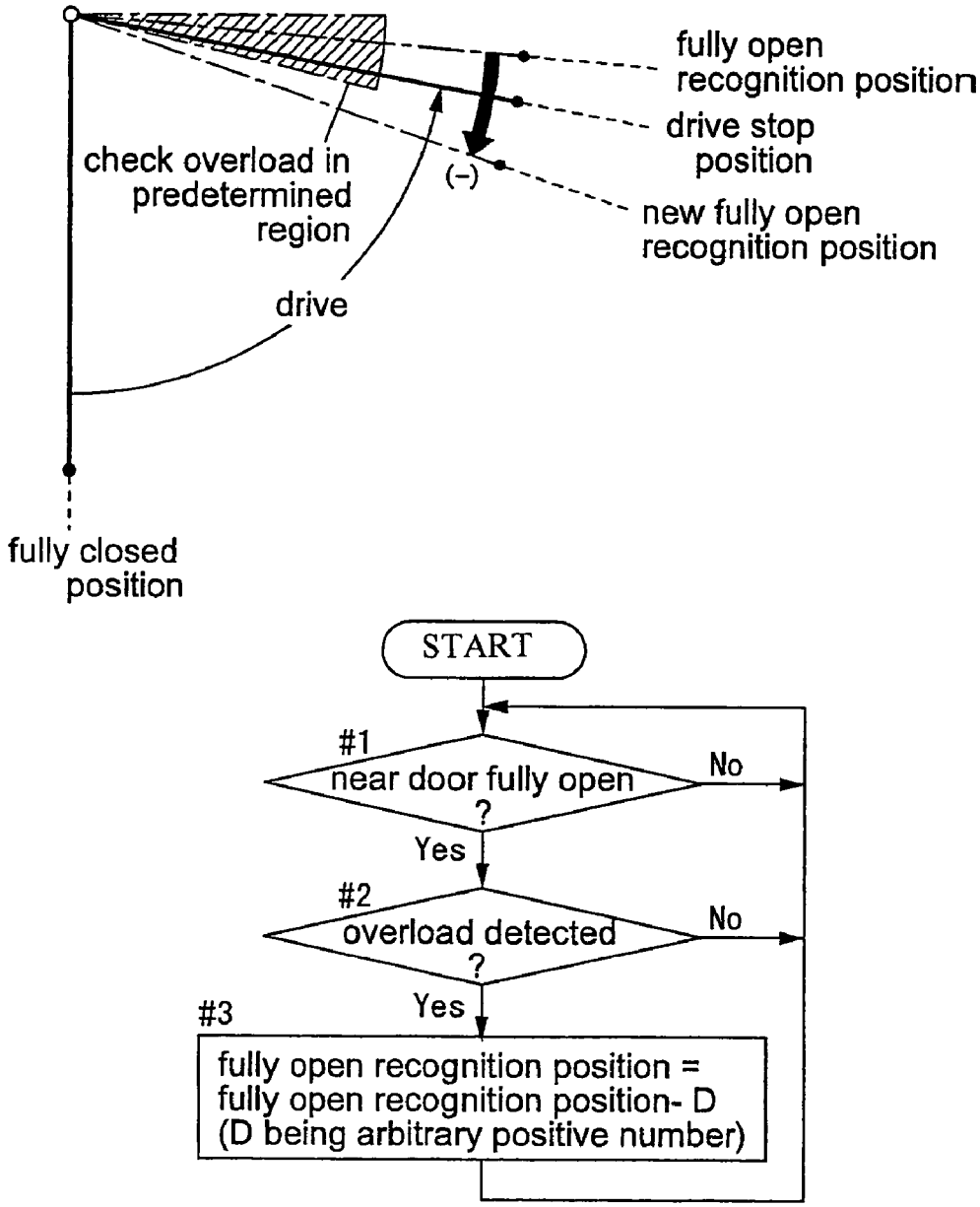
FIG. 8 is an explanatory view showing learning mode 5 of the operating mechanism according to the present invention.

FIG. 8 shows an example where a currently recognized fully open recognition position and drive stop position are beyond the structural fully open position. In this case, when the back door 1 is driven to the drive stop position by the drive motor M, an excessive force will act on certain part of the drive mechanism. Therefore, in order to prevent damage to the door hinges la or the like, it is necessary to correct the currently recognized fully open recognition position to the closing side.

That is, in this learning mode 5, the operating mechanism of the back door 1 includes an overload checking device. In a predetermined region which is a region adjacent said fully open recognition position (#1), the overload checking device may detect an overload (#2). Then, the fully open position storage device 5*a* is caused to recognize a position to the closing side of the fully open recognition position to be a new fully open recognition position (#3).

Specifically, in this embodiment, the controller 5 derives a new fully open recognition position by performing a calculation based on an equation "fully open recognition position=fully open recognition position−D", and stores it in the fully open position storage device 5*a*. Here, D is an arbitrary positive number, and its value usually is set beforehand in time of delivery.

Said overload checking device may, for example, be a rotary encoder attached to said drive motor M. That is, the rotating speed of the motor may be monitored, to determine action of an overload when rotational frequency lowers by a fixed amount relative to a command value.

With this mode, a misrecognition as the fully open recognition position of a position open to a larger extent than the structural fully open position is corrected appropriately, thereby effectively preventing damage to the back door 1 or the drive mechanism.

Other Embodiment

For example, the back door 1 of a minivan usually has right and left air dampers 30 for supporting the back door 1 in a fully open position. These air dampers 30, which are one example of open/close object raising mechanism, act in an extending direction when the back door 1 is near the fully open position. With regard to the opening operation of the back door 1, in normal state, the back door 1 is first driven by the drive motor M to open to the fully open recognition position or to said drive stop position set a fixed amount short of the fully open recognition position. The drive motor M has a clutch using an electromagnetic coupling, for example, and the clutch is disconnected in time of stopping drive. The back door 1, freed from restraint, and under an extending force of the air dampers 30, opens upward and stops in the structural fully open position.

Generally, the motion of the back door 1 should preferably stop sharp in said drive stop position. In reality, however, an excessive opening operation by the drive motor M is prevented by setting the drive stop position open to a smaller extent than the structural fully open position, the further, fixed amount being left to the opening operation by the air dampers 30. With the air dampers 30 provided in this way, the back door 1 is opened reliably to the structural fully open position while the drive by the drive motor M is stopped short to prevent damage to the back door 1. Therefore, the above opening operation by the air dampers 30 is indispensable.

Thus, the learning modes herein aim mainly at realizing a sightly opening operation of the back door 1 by minimizing such opening operation of the air dampers 30.

(Learning Mode 6)

Figure 9:
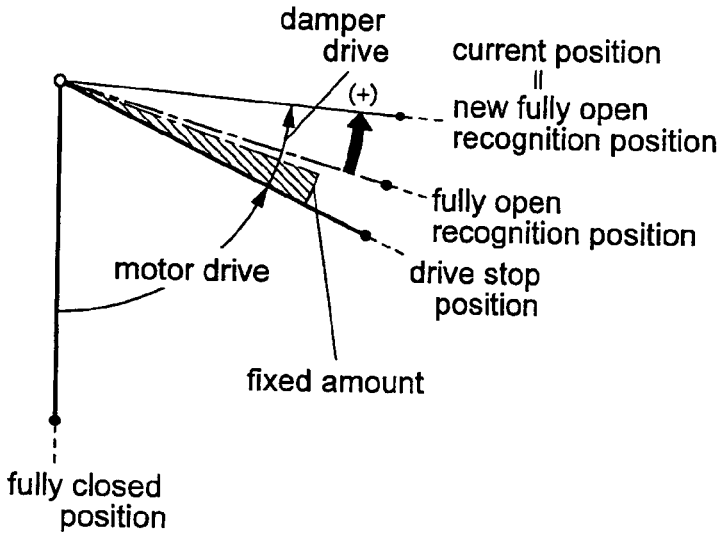
FIG. 9 is an explanatory view showing learning mode 6 of the operating mechanism according to the present invention.
Figure 9:
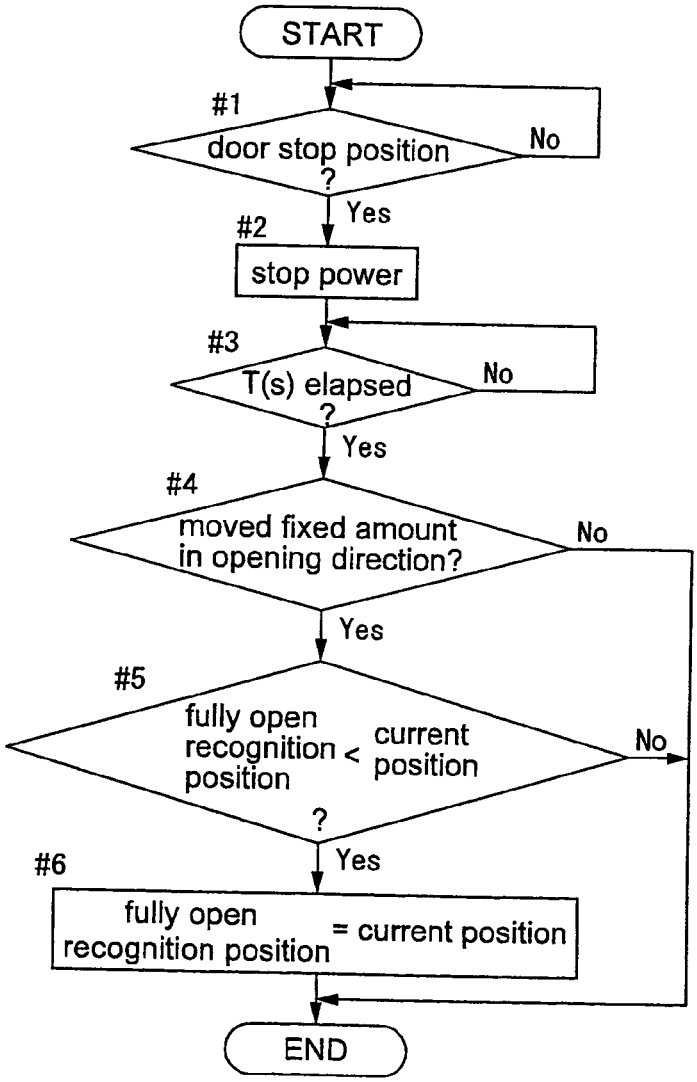

For this purpose, in this learning mode, as shown in FIG. 9, for example, when, after the opening drive by said driving device 3 is completed (#1, 2), within a fixed time T(s) (#3), the back door 1 is operated at least a fixed amount to the open side (#4), and a current position of the back door 1 is open to a larger extent than the fully open recognition position, i.e. "fully open recognition position <current position" (#5), the current position is recognized to be a new fully open recognition position (#6). Here, the fixed time T(s) is set longer than a time needed for the opening operation by the air dampers 30.

With this mode, even where the back door 1 has a mixture of the opening operation by the drive motor M and the opening operation by the air dampers 30, an opening operation may be effected to the vicinity of the structural fully open position by the drive motor M. Moreover, since the opening operation by the air dampers 30 may be set to a minimal stroke, the opening operation of the back door 1 is smooth and pleasing to the sight.

(Learning Mode 7)

Figure 10:
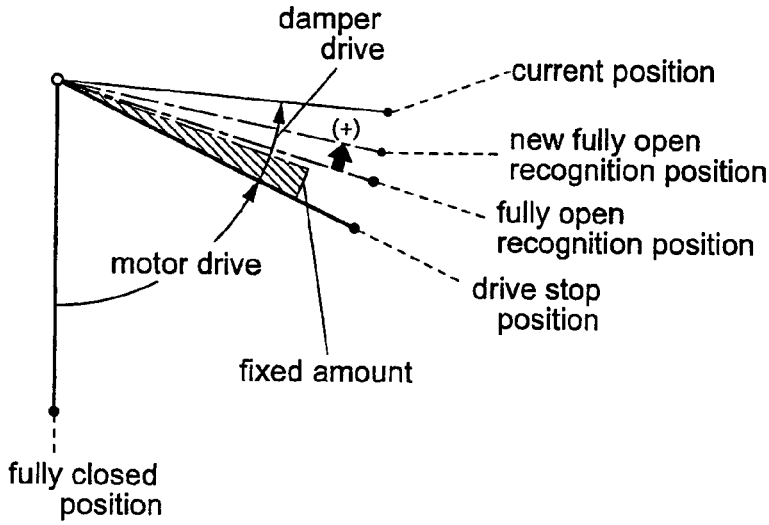
FIG. 10 is an explanatory view showing learning mode 7 of the operating mechanism according to the present invention.
Figure 10:
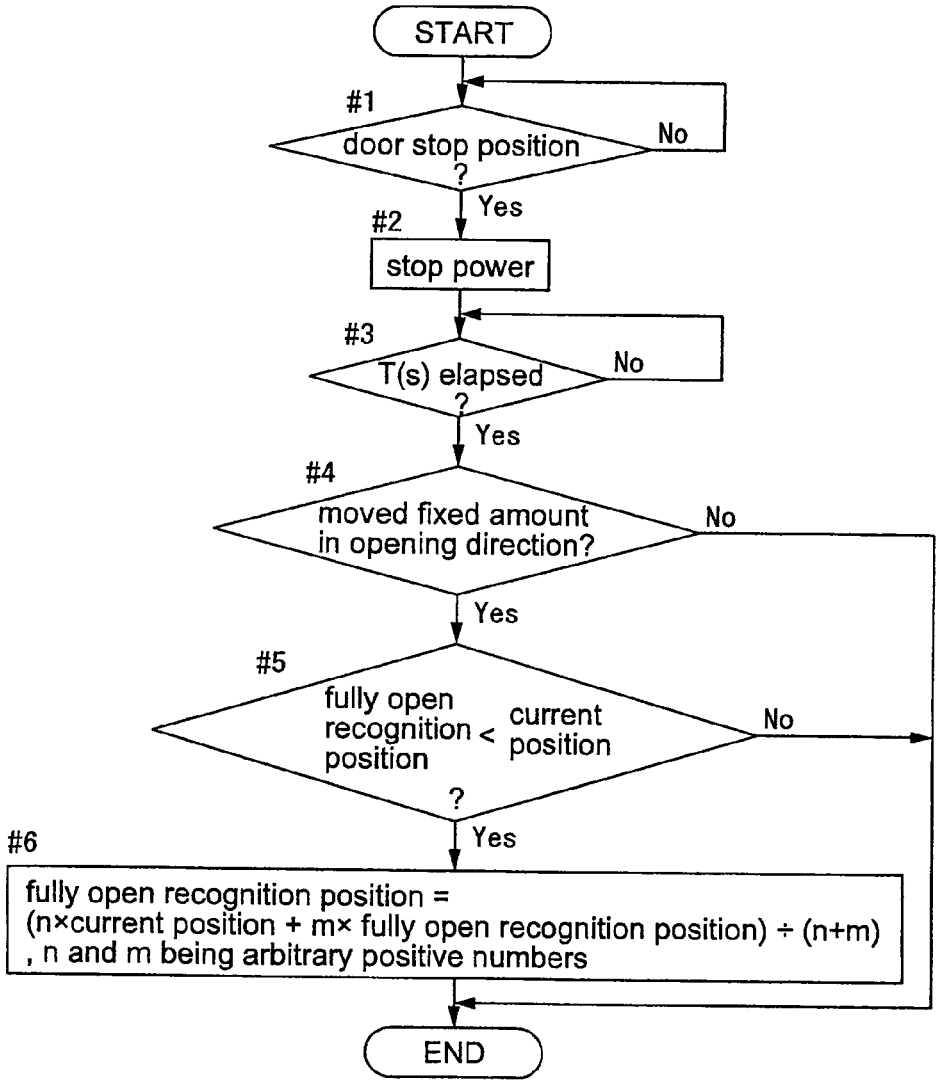

This learning mode will be described with reference to FIG. 10.

The purport of this learning mode, in the mode where the air dampers 30 are used, is the same as the purport of learning mode 2 provided in relation to the foregoing learning mode 1.

In this mode, when, after the opening drive by said driving device 3 is completed (#1, 2), within a fixed time T(s) (#3), the back door 1 is operated at least a fixed amount to the open side (#4), and a current position of the back door 1 is open to a larger extent than the fully open recognition position, i.e. "fully open recognition position<current position" (#5), a position between the current position and said fully open recognition position is recognized to be a new fully open recognition position (#6). A specific process at #6 here may be similar to the process at #2 in the above (Learning Mode 2).

With this mode, also where the back door 1 uses the opening drive by the air dampers 30, the fully open recognition position of the back door 1 may gradually be brought close to the structural fully open position.

(Learning Mode 8)

This learning mode will be described with reference to FIG. 11. This mode, where the air dampers 30 are used, aims at re-setting a new fully open recognition position to the closing side when the fully open recognition position is extremely close to the structural fully open position or is beyond the structural fully open position.

In this mode, when, after the opening drive by said driving device 3 is completed (#1, 2), within a fixed time T(s) (#3), the back door 1 does not operate at least a fixed amount to the open side (#4), a position open to a smaller extent than the fully open recognition position is recognized to be a new fully open recognition position (#6). A specific process at #5 here may be similar to the process at #3 in the above (Learning Mode 5).

A position open to a smaller extent than the fully open recognition position may, for example, be an initial value of the fully open recognition position or a position open to a smaller extent by a selected amount than a current fully open recognition position.

Figure 11:
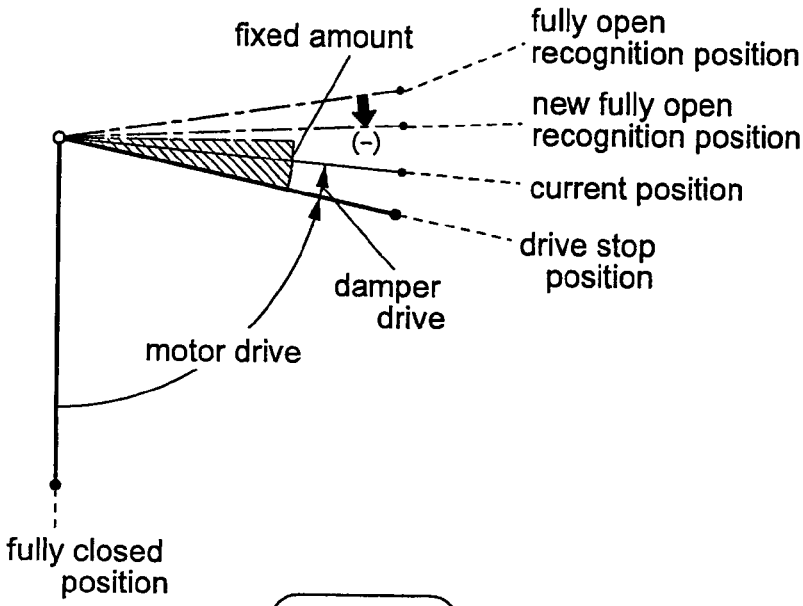
FIG. 11 is an explanatory view showing learning mode 8 of the operating mechanism according to the present invention.
Figure 11:
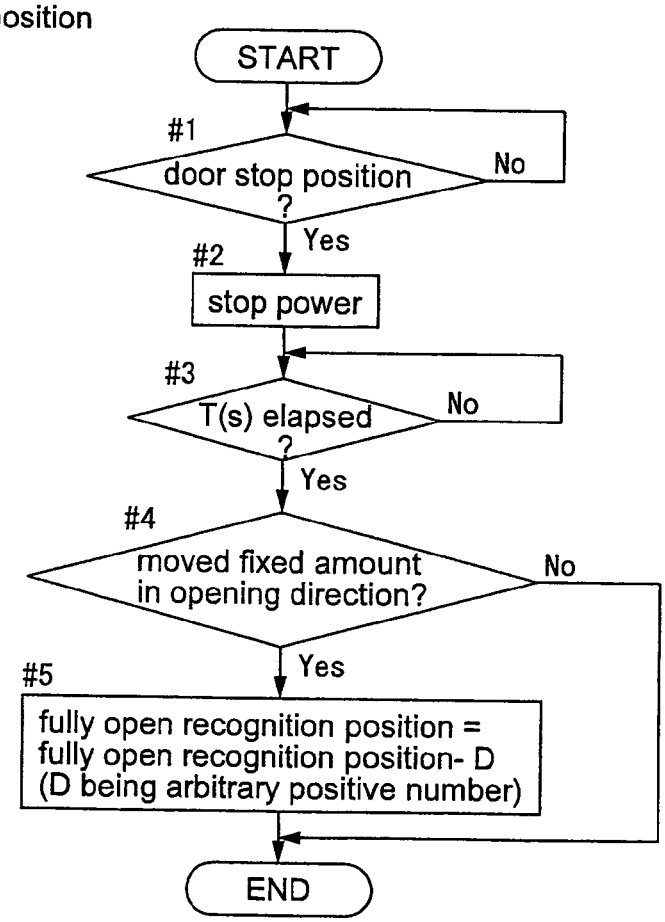

FIG. 11 shows an example where the back door 1, after the opening drive by the drive motor M, is slightly opened by the air dampers 30.

When an amount of opening by the air dampers 30 is smaller than said fixed amount, the back door 1 may easily overshoot the structural fully open position owing to a malfunction of the drive motor M or the like. In order to prevent this, a new fully open recognition position is set to the closing side as in the above mode.

Besides the example shown in FIG. 11, it is also conceivable that a current fully open recognition position is already beyond the structural fully open position of the back door 1. In such a case, of course, a new fully open recognition position is re-set to the closing side.

(Effects)

According to the operating mechanism for an open/close object according to this invention, as described above, the fully open recognition position may be brought close to the structural fully open position without damaging the drive mechanism and the like of the open/close object. That is, even if the fully open recognition position is set to a large extent to the closing side from the structural fully open position, a subsequent correction of the fully open position is easy. Thus, there is no need to assemble the open/close object strictly and, for example, the number of vehicle assembling steps may be reduced.

Even when the structural fully open position changes with use of the open/close object, the fully open recognition position can always be brought close to said structural fully open position. Therefore, after termination of a driving and opening operation, the open/close object stops in a short time to render the opening operation of the open/close object pleasing to the sight. Particularly where the driving device and air dampers are used in combination, a prominent effect can be obtained since the opening operation by both does not appear divided into two stages.

INDUSTRIAL UTILITY

The operating mechanism for the open/close object of this invention may be used for a back door of a minivan, an ordinary vehicle door such as a trunk luggage door or slide door, and further an ordinary garage door which door is the type that opens upward.

The invention claimed is:

1. An operating mechanism for an open/close object comprising:

a driving device for driving open the open/close object;

a position detecting device for detecting an open position of the open/close object; and a fully open position storage device for storing a fully open position of the open/close object;

wherein, when said driving device drives open said open/close object, said driving device is stopped in a drive stop position which is set a fixed amount short of the fully open recognition position stored in said fully open position storage device, while said open/close object continues moving by an open/close object moving mechanism until the open/close object reaches an opening operation ending position;

the operating mechanism, having a position learning function in which, when a current position of the open/close object at the opening operation ending position is different from said fully open recognition position, said fully open position storage device sets a new fully open recognition position.

2. An operating mechanism for an open/close object as defined in claim 1, wherein, when said current position is a position open to a larger extent than said fully open recognition position, said fully open position storage device recognizes said current position to be said new fully open recognition position.

3. An operating mechanism for an open/close object as defined in claim 1, wherein, when said current position is a position open to a larger extent than said fully open recognition position, said fully open position storage device recognizes a position between said current position and said fully open recognition position to be said new fully open recognition position.

4. An operating mechanism for an open/close object as defined in claim 1, wherein said fully open position storage device recognizes a current position of said open/close object upon lapse of a fixed time after completion of the opening drive by said driving device, to be said new fully open recognition position.

5. An operating mechanism for an open/close object as defined in claim 1, wherein said fully open position storage device recognizes a position between a position of said open/close object and said fully open recognition position upon lapse of a fixed time after completion of the opening drive by said driving device, to be said new fully open recognition position.

6. An operating mechanism for an open/close object as defined in claim 1, wherein said open/close object includes an overload checking device, and when the overload checking device detects an overload in a predetermined region which is a region adjacent said fully open recognition position, said fully open position storage device recognizes a position open to a smaller extent than said fully open recognition position to be said new fully open recognition position.

7. An operating mechanism for an open/close object as defined in claim 1, wherein said open/close object includes an open/close object raising mechanism for biasing said open/close object in an opening direction, which causes an opening operation from a position where said drive device is stopped to a structural fully open position of said open/close object.

8. An operating mechanism for an open/close object as defined in claim 7, wherein, when said open/close object operates at least a fixed amount to an opening side within a fixed time after completion of the opening drive by said driving device, and a current position of said open/close object is a position open to a larger extent than said fully open recognition position, said current position is recognized to be said new fully open recognition position.

9. An operating mechanism for an open/close object as defined in claim 7, wherein, when said open/close object operates at least a fixed amount to an opening side within a fixed time after completion of the opening drive by said driving device, and a current position of said open/close object is a position open to a larger extent than said fully open recognition position, a position between said current position and said fully open recognition position is recognized to be said new fully open recognition position.

10. An operating mechanism for an open/close object as defined in claim 7, wherein, when said open/close object does not operate at least a fixed amount to an opening side within a fixed time after completion of the opening drive by said driving device, a position open to a smaller extent than said fully open recognition position is recognized to be said new fully open recognition position.

11. An operating mechanism for an open/close object as defined in claim 1, wherein said open/close object is a vehicle door.

12. A vehicle rear door operating mechanism comprising:

a driving device which performs opening drive to upwardly move the vehicle rear door in an opening direction;

a position detecting device for detecting an open position of the vehicle rear door;

a fully open position storage device for storing a fully open recognition position of the vehicle rear door;

a controller operatively connected to the driving device to control operation of the driving device;

the controller stopping operation of the driving device during upward movement of the vehicle rear door in a drive stop position which is set a fixed amount short of the fully open recognition position stored in the fully open position storage device, and the vehicle rear door continuing to move upward after the operation of the drive device is stopped until the vehicle rear door reaches an opening operation ending position; and when a current position of the vehicle rear door after reaching the opening operation ending position is different from the fully open recognition position currently stored in the fully open position storage device, the controller performs position learning in which a new fully open recognition position different from the fully open recognition position currently stored in the fully open position storage device is stored in the fully open position storage device.

13. A vehicle rear door operating mechanism as defined in claim 12, wherein, when the current position of the vehicle rear door is a position open to a larger extent than the fully open recognition position currently stored in the fully open position storage device, the fully open position storage device recognizes the current position to be the new fully open recognition position.

14. A vehicle rear door operating mechanism as defined in claim 12, wherein, when the current position is a position open to a larger extent than the fully open recognition position currently stored in the fully open position storage device, the fully open position storage device recognizes a position between the current position and fully open recognition position currently stored in the fully open position storage device to be the new fully open recognition position.

15. A vehicle rear door operating mechanism as defined in claim 12, wherein the fully open position storage device recognizes the current position of the vehicle rear door, upon lapse of a fixed time after completion of the opening drive by the driving device, to be the new fully open recognition position.

16. A vehicle rear door operating mechanism as defined in claim 12, wherein the fully open position storage device recognizes a position between the current position of the vehicle rear door and the fully open recognition position currently stored in the fully open position storage device, upon lapse of a fixed time after completion of the opening drive by the driving device, to be the new fully open recognition position.

17. A vehicle rear door operating mechanism as defined in claim 12, wherein the vehicle rear door includes an overload checking device, and when the overload checking device detects an overload in a predetermined region adjacent the fully open recognition position currently stored in the fully open position storage device, the fully open position storage device recognizes a position open to a smaller extent than the fully open recognition position currently stored in the fully open position storage device to be the new fully open recognition position.

18. A vehicle rear door operating mechanism as defined in claim 12, wherein the vehicle rear door includes a damper which biases the vehicle rear door in the opening direction.

19. A vehicle rear door operating mechanism as defined in claim 12, wherein, when the vehicle rear door operates at least a fixed amount in the opening direction within a fixed time after completion of the opening drive by the driving device, and a current position of the vehicle rear door is a position open to a larger extent than the fully open recognition position, the current position of the vehicle rear door is recognized to be the new fully open recognition position.

20. A vehicle rear door operating mechanism as defined in claim 12, wherein, when the vehicle rear door operates at least a fixed amount in the opening direction within a fixed time after completion of the opening drive by the driving device, and a current position of the vehicle rear door is a position open to a larger extent than the fully open recognition position currently stored in the fully open position storage device, a position between the current position of the vehicle rear door and the fully open recognition position currently stored in the fully open position storage device is recognized to be the new fully open recognition position.

* * * * *